US009818335B2

(12) United States Patent
Wu

(10) Patent No.: US 9,818,335 B2
(45) Date of Patent: Nov. 14, 2017

(54) DISPLAY WITH APPARATUS FOR COMPENSATING IMAGE AND DISPLAY ASSEMBLY

(71) Applicant: Ye Xin Technology Consulting Co., Ltd., Hsinchu (TW)

(72) Inventor: I-Wei Wu, Hsinchu (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 112 days.

(21) Appl. No.: 14/499,516

(22) Filed: Sep. 29, 2014

(65) Prior Publication Data

US 2015/0091953 A1 Apr. 2, 2015

(30) Foreign Application Priority Data

Sep. 27, 2013 (TW) ..... 102135216 A

(51) Int. Cl.
*G09G 3/34* (2006.01)
*G09G 3/20* (2006.01)

(52) U.S. Cl.
CPC ..... *G09G 3/2007* (2013.01); *G09G 3/34* (2013.01); *G09G 2300/023* (2013.01); *G09G 2300/026* (2013.01); *G09G 2310/0232* (2013.01); *G09G 2320/0233* (2013.01); *G09G 2320/0285* (2013.01)

(58) Field of Classification Search
CPC ..... G09G 2300/026
See application file for complete search history.

(56) References Cited

U.S. PATENT DOCUMENTS

| | | | | |
|---|---|---|---|---|
| 6,115,092 | A | 9/2000 | Greene et al. | |
| 8,780,015 | B2 | 7/2014 | Watanabe | |
| 8,872,740 | B2 | 10/2014 | Yamashita et al. | |
| 2004/0051944 | A1 | 3/2004 | Stark | |
| 2006/0007369 | A1 | 1/2006 | Jin et al. | |
| 2007/0085792 | A1* | 4/2007 | Tseng | G09G 3/3275 345/89 |
| 2011/0221760 | A1* | 9/2011 | Irie | G09G 3/3648 345/589 |
| 2012/0242714 | A1* | 9/2012 | Narimatsu | G02F 1/133621 345/690 |
| 2013/0176352 | A1* | 7/2013 | Watanabe | G09G 3/34 345/690 |

FOREIGN PATENT DOCUMENTS

| | | |
|---|---|---|
| CN | 101965604 | 2/2011 |
| CN | 102543035 | 7/2012 |
| CN | 101996618 | 11/2013 |
| TW | 500942 A | 9/2002 |

* cited by examiner

*Primary Examiner* — Jennifer Mehmood
*Assistant Examiner* — Carl Adams
(74) *Attorney, Agent, or Firm* — Steven Reiss

(57) ABSTRACT

A display comprises a display panel and an image compensating portion. The display panel comprises a main display region and a periphery display region outside the main display region. Each of the main display region and the periphery display region respectively comprises a plurality of pixels. When a pixel of the main display region and a pixel of the periphery display region have the same original gray scale, an intensity of lights from the pixels in the periphery display region is greater than an intensity of lights from the pixels in the main display region.

20 Claims, 20 Drawing Sheets

DISPLAY WITH APPARATUS FOR COMPENSATING IMAGE AND DISPLAY ASSEMBLY

CROSS-REFERENCE TO RELATED APPLICATIONS

This application is related to U.S. patent application Ser. No. 14/499,538 and entitled "DISPLAY, DISPLAY ASSEMBLY AND BACKLIGHT MODULE", U.S. patent application Ser. No. 14/499,553 and entitled "APPARATUS FOR COMPENSATING IMAGE OF DISPLAY AND DISPLAY ASSEMBLY", U.S. patent application Ser. No. 14/546,171 and entitled "APPARATUS FOR COMPENSATING IMAGE OF DISPLAY AND DISPLAY ASSEMBLY", U.S. patent application Ser. No. 14/164,118 filed on Jan. 24, 2014, entitled "DISPLAY DEVICE, JOINT DISPLAY AND BACKLIGHT MODULE"; U.S. patent application Ser. No. 14/164,139 filed on Jan. 25, 2014, entitled "APPARATUS FOR COMPENSATING IMAGE OF DISPLAY AND METHOD FOR MANUFACTURING SAME"; U.S. patent application Ser. No. 14/164,140 filed on Jan. 25, 2014, entitled "APPARATUS FOR COMPENSATING IMAGE OF DISPLAY AND METHOD FOR MANUFACTURING SAME"; U.S. patent application Ser. No. 14/164,136 filed on Jan. 25, 2014, entitled "APPARATUS FOR COMPENSATING IMAGE OF DISPLAY, DISPLAY AND JOINT DISPLAY"; and U.S. patent application Ser. No. 14/164,137 filed on Jan. 25, 2014, entitled "DISPLAY ELEMENT, DISPLAY DEVICE AND JOINT DISPLAY". This application claims priority to Taiwanese Patent Application No. 102135216 filed on Sep. 27, 2013, the contents of which are incorporated by reference herein.

FIELD

The present disclosure relates to a display with an image compensating apparatus and a display assembly with at least two displays.

BACKGROUND

In order to obtain a display panel of a relative large size, it may be manufactured by a large number of serialization displays jointed together in a plane. The borders between two adjacent display panels jointing together are un-visible.

BRIEF DESCRIPTION OF THE FIGURES

Implementations of the present technology will now be described, by way of example only, with reference to the attached figures.

DETAILED DESCRIPTION

Figure 1:
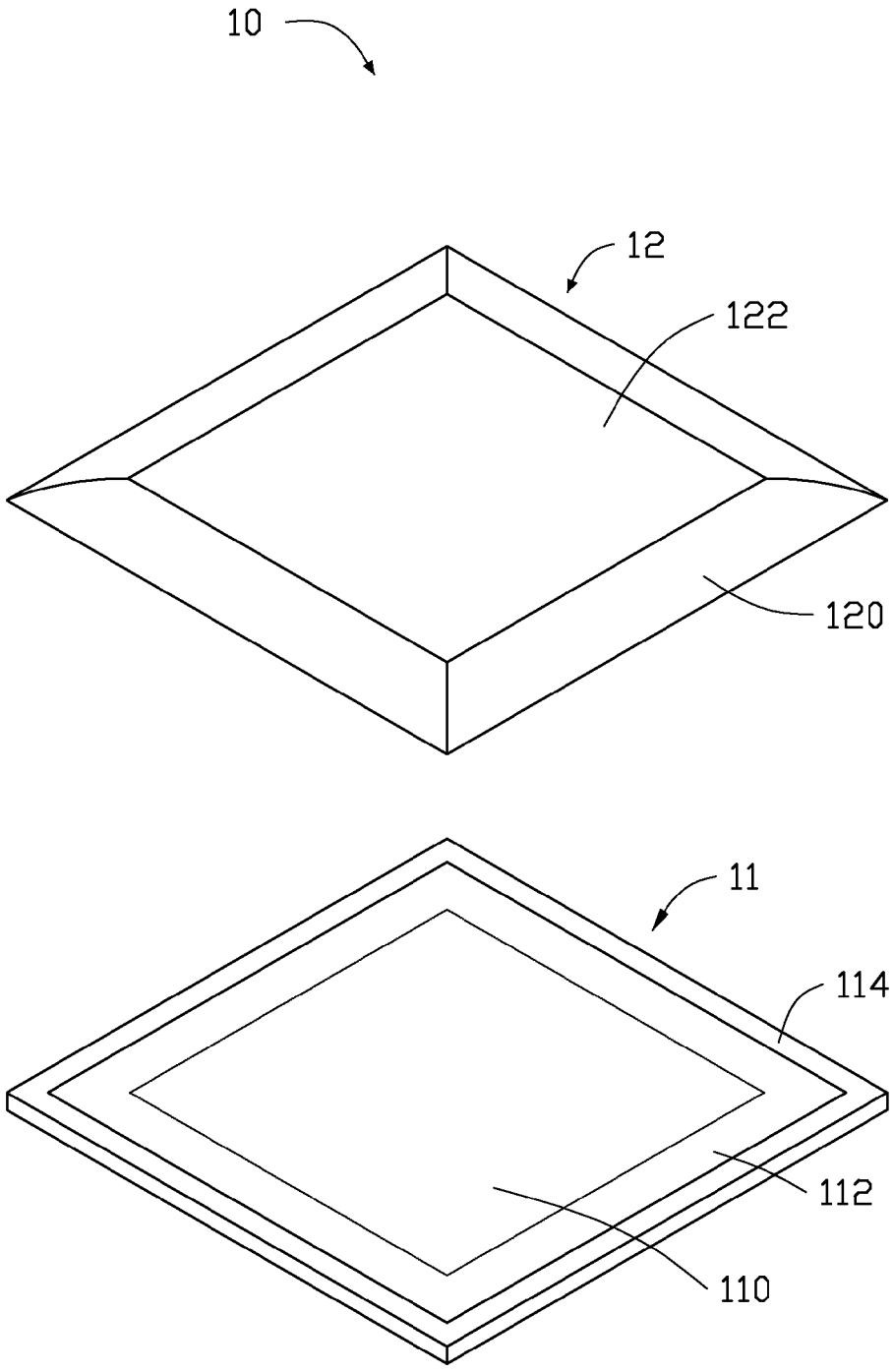
FIG. 1 is a partially exploded view of an embodiment of a display, the display including a display panel.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

The present disclosure is described in relation to a display with a zero border.

Figure 2:
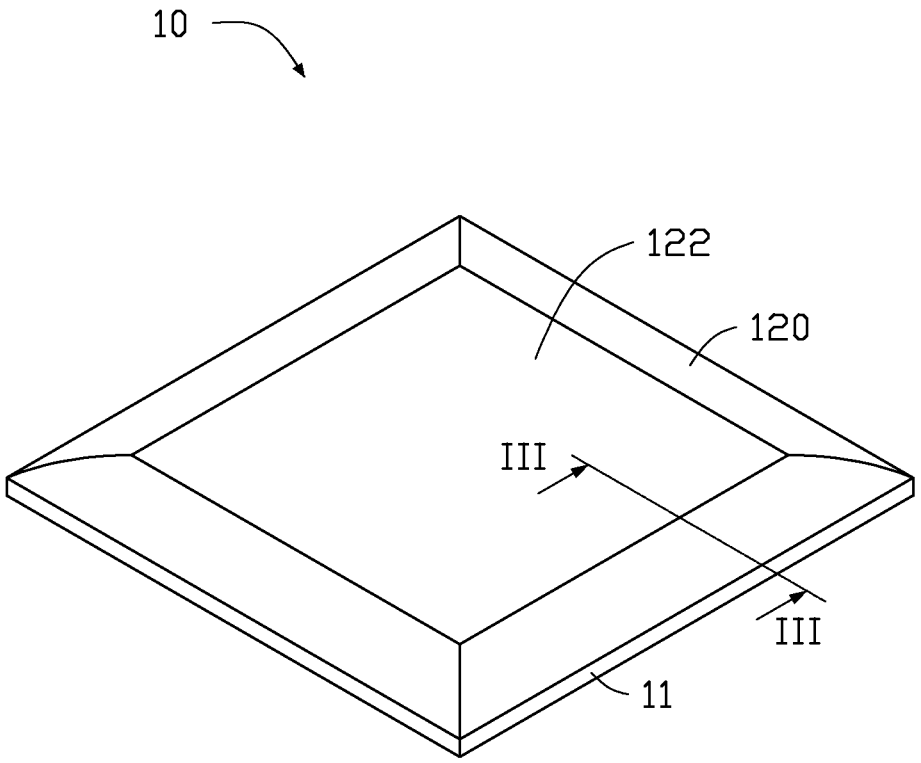
FIG. 2 is an isometric view of an embodiment of the display of FIG. 1.
Figure 3:
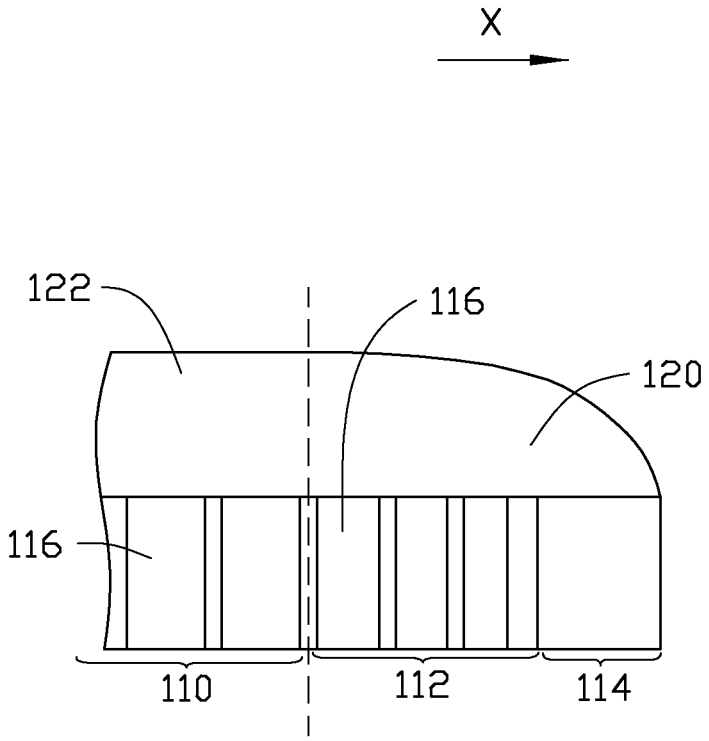
FIG. 3 is a cross-section view of an embodiment of the display of FIG. 2, taken along a line III-III thereof.

FIGS. 1-3 illustrate an embodiment of a display 10. The display 10 includes a display panel 11 and an image compensating apparatus 12 located on the display panel 11. In at least one embodiment, the display panel 11 is a liquid crystal display (LCD) panel, an organic light emitting display (OLED) panel, or an electrowetting display panel.

The display panel 11 includes a main display region 110, a periphery display region 112 located outside of the main display region 110, and a non-display region 114 located outside the periphery display region 112. In at least one embodiment, the non-display region 114 is a border of the display 10.

The main display region 110 and the periphery display region 112 include a plurality of pixels 116 arranged as a matrix. Areas of the pixels 116 in the main display region 110 are constant, and any two adjacent pixels 116 in the main display region 110 are spaced in a first distance. Moreover, any two adjacent pixels 116 in the periphery display region 112 are spaced in a second distance. A pixel density of the main display region 110 is less than a pixel density of the periphery display region 112. The first distance is greater than the second distance, and the constant area of the pixel 116 in the main display region 110 is greater than the area of the pixel 116 in the periphery display region 112. Areas of the pixel 116 in the periphery display region 112 gradually decrease in a direction away from the main display region 110. In at least one embodiment, a length of the pixel 116 in the main display region 110 is greater than a length of the pixel 116 in the periphery display region 112, or a width of the pixel 116 in the main display region 110 is greater than a width of the pixel 116 in the periphery display region 112. The length of the pixel 116 is parallel with a direction X, and the width of the pixel 116 is parallel with a direction Y perpendicular to the direction X.

Figure 4:
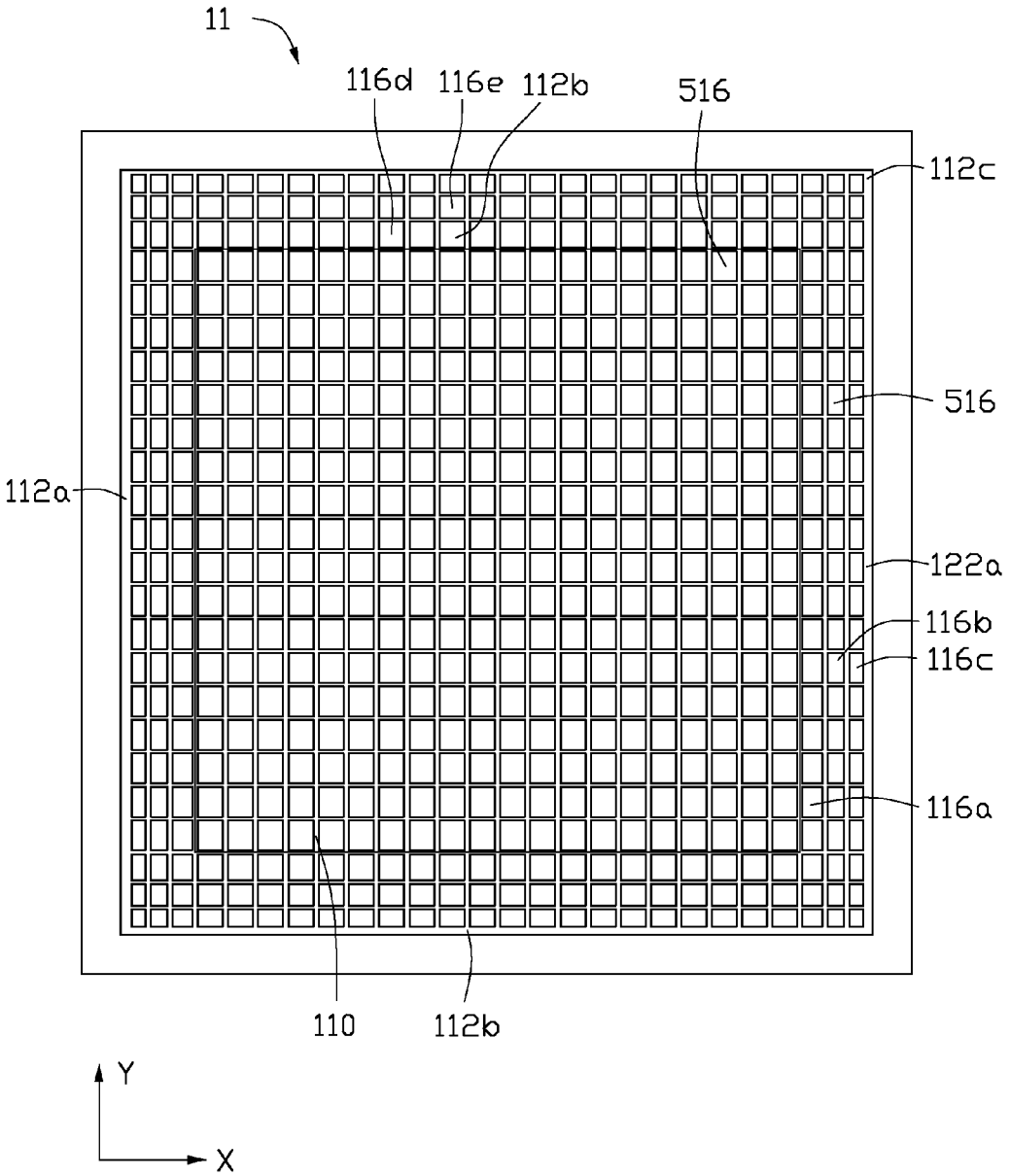
FIG. 4 is a diagrammatic view of an embodiment of the display panel of FIG. 1.

FIG. 4 illustrates an embodiment of the display panel 11. In this embodiment, widths of the pixel 116 in the periphery display regions 112*a* located on a right side and a left side of the main display region 110 gradually decrease along a direction away from the main display region 110. A length of the pixel 116 in the periphery display region 112*a* is equal to a length of the pixel 116 in the main display region 110, and a width of the pixel 116 in the periphery display region 112*a* is less than a width of the pixel 116 in the main display region 110. In detail, a width of the pixel 116*a* adjacent to the main display region 110 is W1, and a width of the main display region 110 is W2. W1=W2−⅓*W2=⅔W2. Pixels 116*b* and 116*c* adjacent to each other are arranged in a line away from the main display region 110. A distance between the pixel 116*b* and the main display region 110 is less than a distance between the pixel 116*c* and the main display region 110. A width of the pixel 116*b* is W3, and a width of the pixel 116*c* is W4. W3=W4−⅓*W4=⅔*W4.

Lengths of the pixels 116 in the periphery display regions 112*b* located on an upper side and a lower side of the main display region 110 gradually decreases along a direction away from the main display region 110. A width of the pixel 116 in the periphery display region 112*b* is equal to a width of the pixel 116 in the main display region 110, and a length of the pixel 116 in the periphery display region 112*b* is less than a length of the pixel 116 in the main display region 110. In detail, a length of the pixel 116*d* adjacent to the main display region 110 is L1, and a length of the main display region 110 is L2. L1=L2−⅓*L2=⅔L2. Pixels 116*e* and 116*f* adjacent to each other are arranged in a line away from the main display region 110. A distance between the pixel 116*e* and the main display region 110 is less than a distance between the pixel 116*f* and the main display region 110. A width of the pixel 116*e* is L3, and a width of the pixel 116*f* is L4. L3=L4−⅓*L4=⅔*L4.

Widths and lengths of the pixels 116 in the periphery display regions 112*c* located at corners gradually decreases along a direction away from the main display region 110. A length of the pixel 116 in the periphery display region 112*c* is less than a length of the pixel 116 in the main display region 110, and a width of the pixels 116 in the periphery display regions 112*c* is less than a width of the pixel 116 in the main display region 110. In at least one embodiment, a length of the pixel 116 in the periphery display region 112*c* is equal to a length of the pixel 116 in the periphery region 112*a*, and a width of the pixel 116 in the periphery display region 112*c* is equal to a width of the pixel 116 in the periphery region 112*b*.

An image covering region of the periphery display region 112*a* is being extended by the image compensating apparatus 12 in a width direction, an image covering region of the periphery display region 112*b* is being extended by the image compensating apparatus 12 in a length direction, and an image covering region of the periphery display region 112*c* is being extended by the image compensating apparatus 12 in a width and length directions simultaneously, thus an image display effect of the periphery display region 112 is equal to an image display effect of the main display region 110.

The image compensating apparatus 12 includes image compensating portion 122 and a transmission portion 122 corresponding to the main display region 110. The transmission portion 122 is connected to the image compensating portion 122. A light emitting surface of the image compensating portion 120 is a substantially arc shaped. Radians of the different light emitting surfaces of the image compensating portion 122 corresponding the periphery display region 112*a*, the periphery display region 112*b*, and the periphery display region 112*c* are different with each other.

Figure 5:
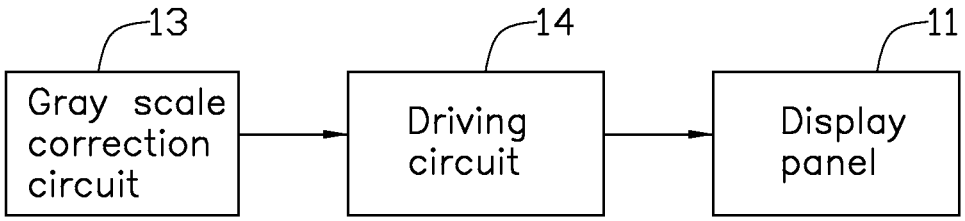
FIG. 5 is a block diagram of an embodiment of the display of FIG. 1, the display including a gray scale correction circuit.

FIG. 5 illustrates that the display 10 further includes a gray scale correction circuit 13 and a driving circuit 14. The gray scale correction circuit 13 obtains a first original gray scale value of the periphery display region 112 and a second original gray scale value of the main display region 110 based on decode image data of the display 10.

The gray scale correction circuit 13 presets a first correction value. The gray scale correction circuit 13 obtains a first correction gray scale value based on the first original gray scale value. The driving circuit 14 converts the first correction gray scale value into a first driving signal. The driving circuit 14 transmits the first driving signal to the pixels in the periphery 112, and the second original gray scale value to the pixels 116 in the main display region 110. The first correction gray scale value is greater than the first original gray scale value, thus a light intensity of the pixels in the periphery is increased by the gray scale correction circuit 13. The first original gray scale value corresponds to a standard intensity.

Figure 6:
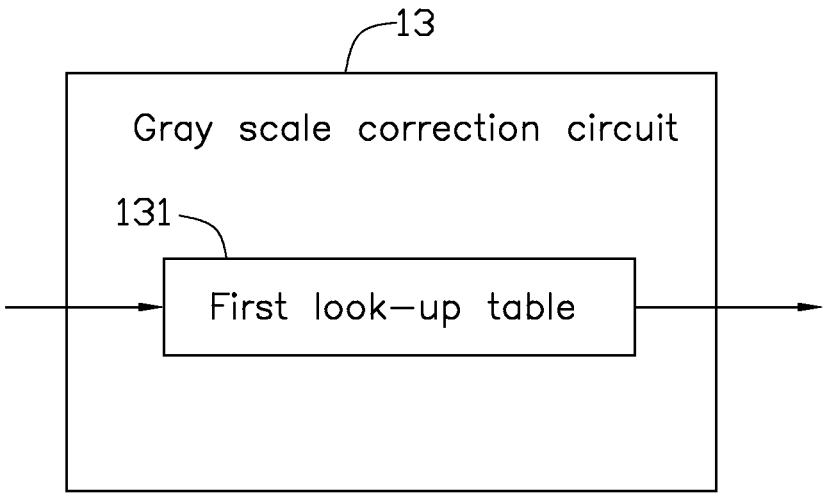
FIG. 6 is a circuit diagram of an embodiment of the gray scale correction circuit of FIG. 5.

FIG. 6 illustrates that the gray scale correction circuit 13 comprises a first look-up table 131. The first look-up table 131 includes a plurality of first original gray scale values and a plurality of first correction gray scale values corresponding to the first original gray scale values in an one-to-one relationship. The corresponding first correction gray scale value is obtained via searching the first original gray scale value in the first look-up table 131. The driving circuit 14 converts the first correction gray scale value into a first driving signal, and the second original gray scale value into a second driving signal. The driving circuit 14 transmits the first driving signal to the pixels 116 in the periphery display region 112, and the second driving signal to the pixels 116 in the main display region 110. The first correction gray scale value is greater than the first original gray scale value.

Figure 7:
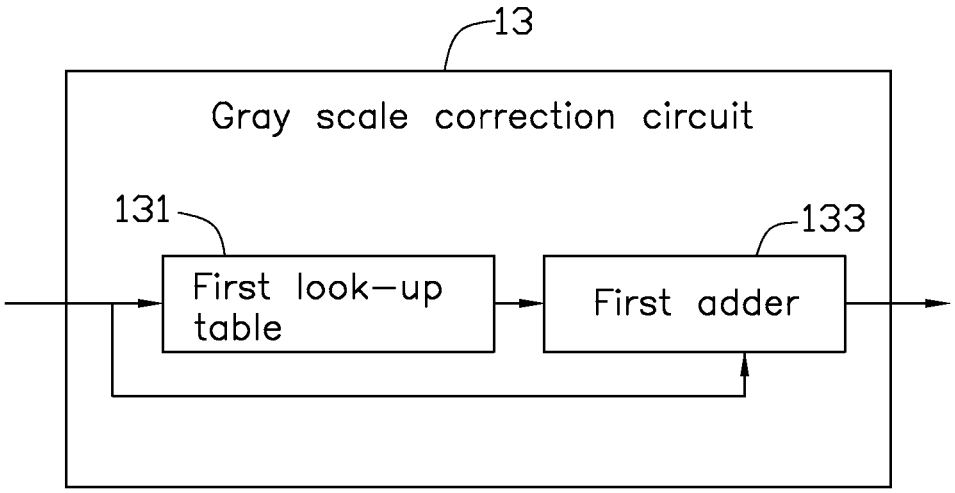
FIG. 7 is a block diagram of a second embodiment of the gray scale correction circuit of FIG. 5.

FIG. 7 illustrates a second embodiment of the gray scale correction circuit 13. The gray scale correction circuit 13 comprises a first look-up table 131 and an adder 133. The first look-up table 131 includes a plurality of first original gray scale values and a plurality of first correction values corresponding to the first original gray scale values in an one-to-one relationship. The corresponding first correction value is obtained via searching the first original gray scale value in the first look-up table 131. The first adder 133 adds the searched first correction value and the first original gray scale value to obtain the first correction gray scale value. The driving circuit 14 converts the first correction gray scale value into a first driving signal, and the second original gray scale value into a second driving signal. The driving circuit 14 transmits the first driving signal to the pixels 116 in the periphery display region 112, and the second driving signal to the pixels 116 in the main display region 110. The first correction gray scale value is greater than the first original gray scale value.

Figure 8:
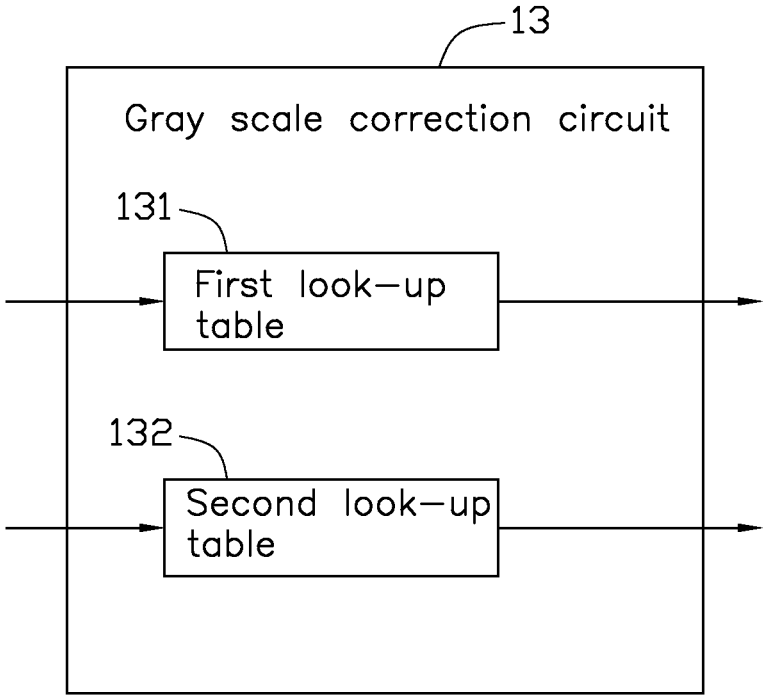
FIG. 8 is a block diagram of a third embodiment of the gray scale correction circuit of FIG. 5.

FIG. 8 illustrates a third embodiment of the gray scale correction circuit 13. The gray scale correction circuit 13 includes a first look-up table 131 and a second look-up table 132. The first look-up table 131 includes a plurality of first original gray scale values and a plurality of first correction values corresponding to the first original gray scale values in an one-to-one relationship. The corresponding first correction value is obtained via searching the first original gray scale value in the first look-up table 131. The second look-up table 132 includes a plurality of second original gray scale values and a plurality of second correction values corresponding to the second gray scale values in an one-to-one relationship. The corresponding second correction value is obtained via searching the second original gray scale value in the second look-up table 132. The driving circuit 14 converts the first correction gray scale value into a first driving signal, and the second correction gray scale value into a second driving signal. The driving circuit 14 transmits the first driving signal to the pixels 116 in the periphery display region 112, and the second driving signal to the pixels 116 in the main display region 110. In other embodiments, the periphery display region 112*a* or 112*b* define a first original gray scale value, and the periphery display region 112*c* defines a third original gray scale value. The gray scale correction circuit 13 adds the first original gray scale value and the first correction value to obtain the first correction gray scale value, and adds the third original gray scale value and the third correction value to obtain a second correction gray scale value. The driving circuit 14 converts the first correction gray scale value into a first driving signal, converts the and converts the second correction gray scale value into a third driving signal. The driving circuit 14 further transmits the first driving signal to the pixels 116 in the periphery display region 112*a* or 112*b*, and the third driving signal to the pixels 116 in the periphery display region 112*c*.

Figure 9:
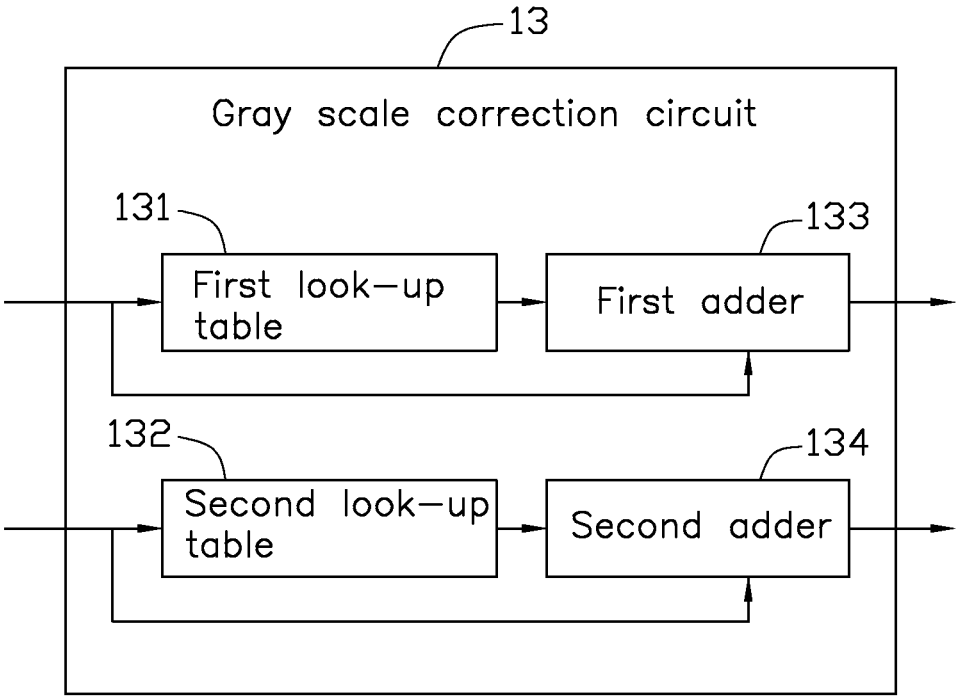
FIG. 9 is a block diagram of a fourth embodiment of the gray scale correction circuit of FIG. 5.

FIG. 9 illustrates a fourth embodiment of the gray scale correction circuit 13. The gray scale correction circuit 13 includes a first look-up table 131, a second look-up table 132, a first adder 133, and a second adder 134. The first look-up table 131 includes a plurality of first original gray scale values and a plurality of first correction values corresponding to the first original gray scale values in an one-to-one relationship. The corresponding first correction value is obtained via searching the first original gray scale value in the first look-up table 131. The first adder 133 adds the searched first correction value and the first original gray scale value to obtain the first correction gray scale value. The second look-up table 132 includes a plurality of second original gray scale values and a plurality of second correction values corresponding to the second gray scale values in an one-to-one relationship. The corresponding second correction value is obtained via searching the second original gray scale value in the second look-up table 132. The second adder 134 adds the searched second correction value and the second original gray scale value to obtain the second correction gray scale value. The driving circuit 14 converts the first correction gray scale value into a first driving signal, and the second correction gray scale value into a second driving signal. The driving circuit 14 transmits the first driving signal to the pixels 116 in the periphery display region 112, and the second driving signal to the pixels 116 in the main display region 110. In other embodiments, the second look-up table 133 includes a plurality of third original gray scale values and a plurality of third correction gray scale values corresponding to the third original gray scale values in an one-to-one relationship. The corresponding first correction value is obtained via searching the first original gray scale value in the first look-up table 131, and the third correction value is obtained via searching the third gray scale value in the second look-up table 132. The first adder 133 adds the first original gray scale value and the first correction value to obtain a first correction gray scale value. The second adder 134 adds the third original gray scale value and the third correction value to obtain a third correction gray scale value. The driving circuit 14 converts the first correction gray scale value into a first driving signal, and the third correction gray scale value into a third driving signal. The driving circuit 14 transmits the first driving signal to the pixels 116 in the periphery display region 112*a* or 112*b*, and the third driving signal to the pixels 116 in the periphery display region 112*c*. Based on the same original gray scale values of the periphery display regions 112*a*, 112*b*, and 112*c*, the light intensity emitted by the periphery display region 112*c* is greater than the light intensity emitted by the periphery display region 112*a* or 122*b*. After passing through the image compensating apparatus 12, the light intensity of the periphery display regions 112*a*, 112*b*, and 112*c* are nearly equal.

While working, a travelling path of lights emitted from the main display region 110 passing through the transmission portion 122 is straight. Lights passing through the image compensating portion 120 is being focused, thus an image covering region of the pixels 116 in the periphery display region 112 extends to the non-display region 114 outside the periphery display region 112. The image compensating portion 120 extends an image covering region of the periphery display region 112 to cover an area combined by upper regions of the periphery display region 112 and the non-display region 114. Images displayed by the pixels 116 in the periphery display region 112 is being enlarged for being equal to images displayed by the pixels in the main display region 110. A displaying region of the display 10 is being extended, and is greater than the size of the display 10. The display 10 has a zero border effect. A light intensity of the pixels 116 in the periphery display region 112 after passed through the image compensating apparatus 12 is improved via the gray scale correction circuit 13 for being equal to a light intensity of the pixels 116 in the main display region 110, thus a light intensity of the display 10 is uniformity for improving displaying effect.

Figure 10:
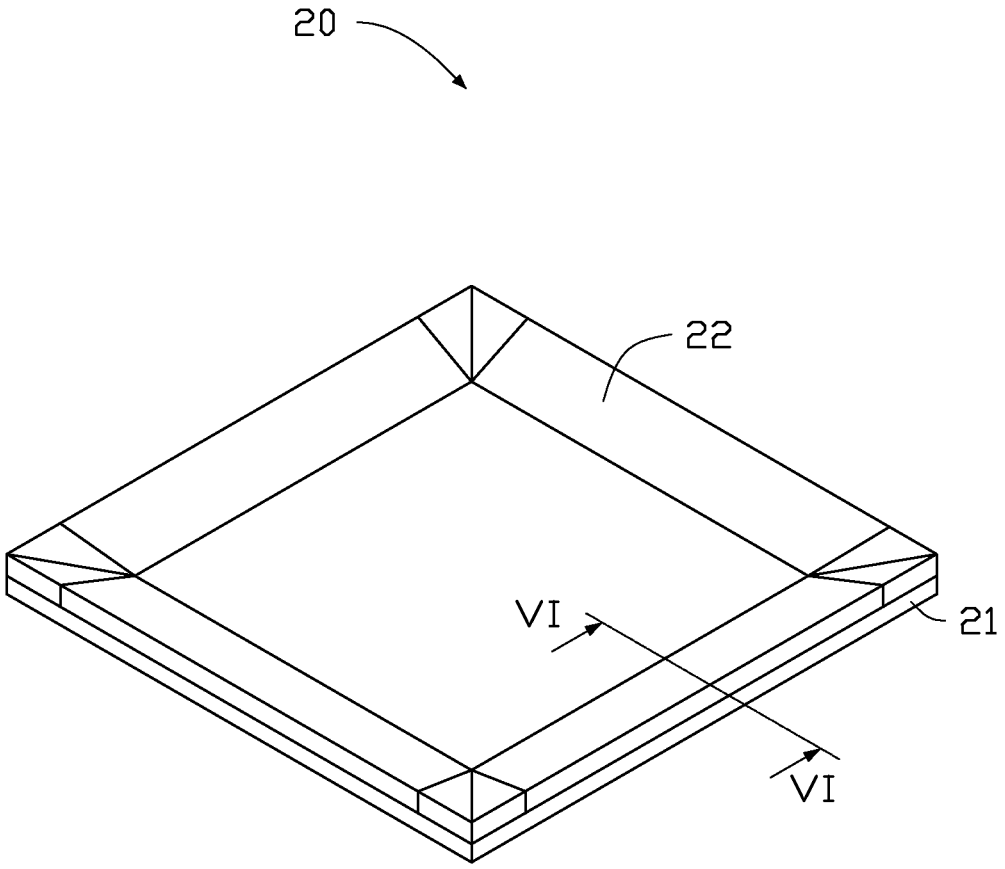
FIG. 10 is an isometric view of a second embodiment of the display, the display including a plurality of light guiding channels.
Figure 11:
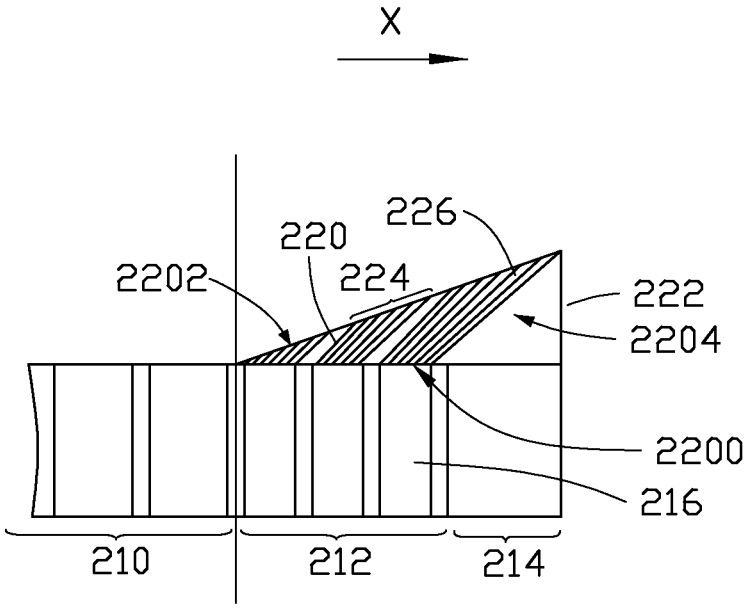
FIG. 11 is a cross-section view of an embodiment of the display of FIG. 10, taken along a line VI-VI thereof.

FIGS. 10-11 illustrate a second embodiment of the display 20. An image compensating apparatus 22 includes an image compensating portion 220 and a plurality of supporting portions 222 connected with the image compensating portion 220. The supporting portion 222 is located on the non-display region 214 and connects with the image compensating portion 220.

The image compensating portion 220 is located on a periphery display region 212. A projection of the image compensating portion 220 on a display panel 21 covers the periphery display region 212 and a non-display region 214 simultaneously. The image compensating portion 220 is substantially an obtuse triangle shaped. The image compensating portion 220 includes a light incident surface 2200 resisting with the periphery display region 212, a light emitting surface 2202, and an inclined surface 2204. An end of the light emitting surface 2202 is connected to the light incident surface 2200, another end of the light emitting surface 2202 is connected to the inclined surface 2204. An area of a projection of the light emitting surface 2202 on the light incident surface 2200 is greater than an area of the light incident surface 2200. The first light incident surface 1220 faces to the periphery display region 212. The first light emitting surface 1222 and the first light incident surface 2200 define an acute angle. The inclined surface 2204 and the light incident surface 2200 define an obtuse angle.

Figure 12:
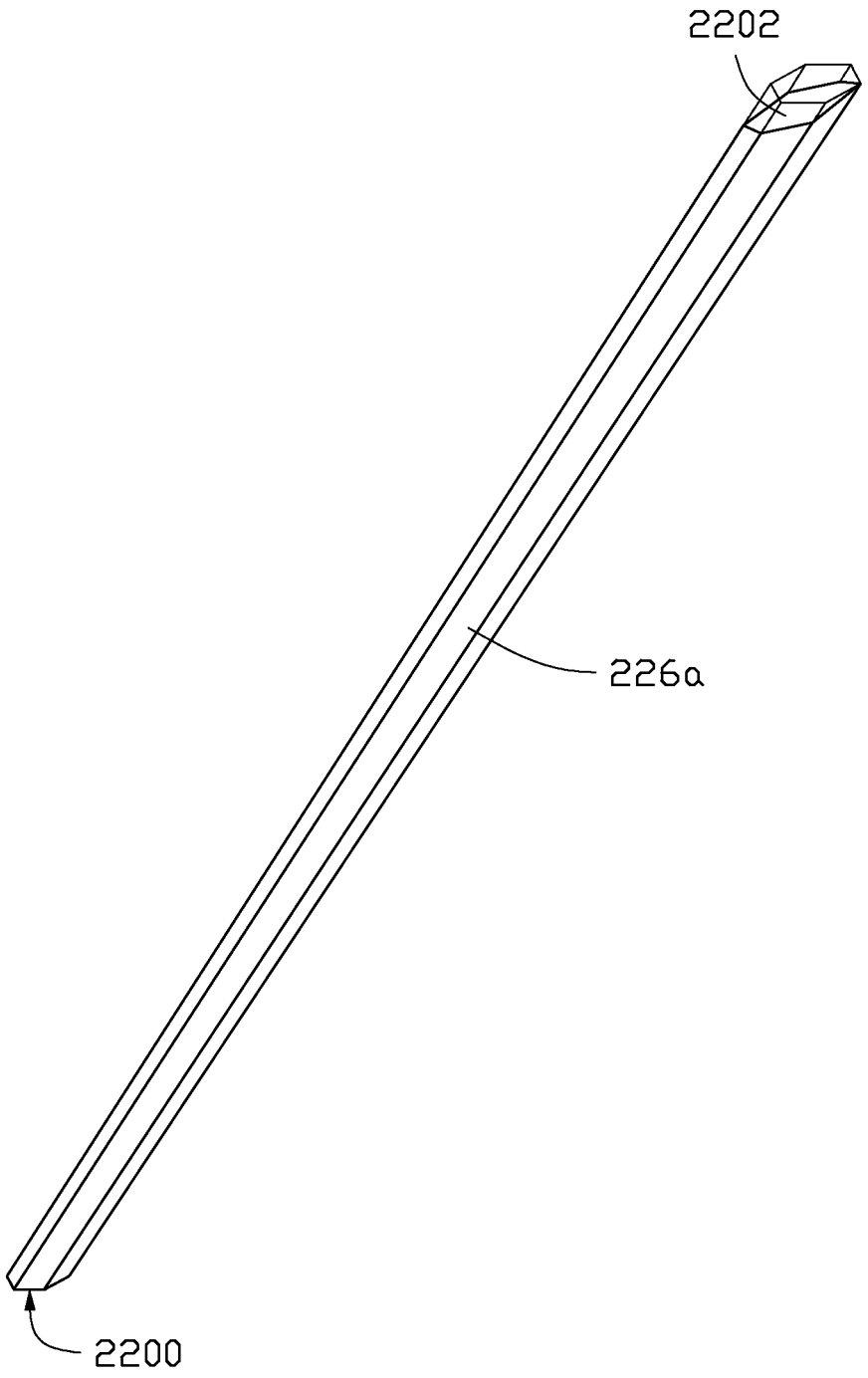
FIG. 12 is an isometric view of an embodiment of the light guiding channel.

FIG. 12 illustrates that the image compensating portion 220 further includes a plurality of light guiding channels 224. The light guiding channel 224 includes a plurality of light guiding fiber 226. The light guiding fiber 226 extends an image covering region of the periphery display region 212 to cover an area combined by upper regions of the periphery display region 212 and the non-display region 214. Areas of cross sections of the light guiding fiber 226*a* gradually ascend. The light guiding fiber 226*a* is extended from the periphery display region 210 along a direction away from the main display region 210. A projection area of the light guiding channel 224 on the light incident surface 2200 is greater than a projection area of the light guiding channel 224 on the light emitting surface 2202. Ratios between the projection area of the light guiding channel 224 on the light incident surface 2200 and the projection area of the light guiding channel 224 on the light emitting surface 2202 gradually ascend. An extending degree of the light guiding fiber 226*a* is related to inclined degree and diameter of the light guiding fiber 226*a*. Images displayed by the pixels 216 of the periphery display region 212 is extended by the light guiding fiber 226*a* for being equal to images displayed by the main display region 210. The pixels 216 in the periphery display region 212 are equal to the pixels 216 in the main region 210.

Figure 13:
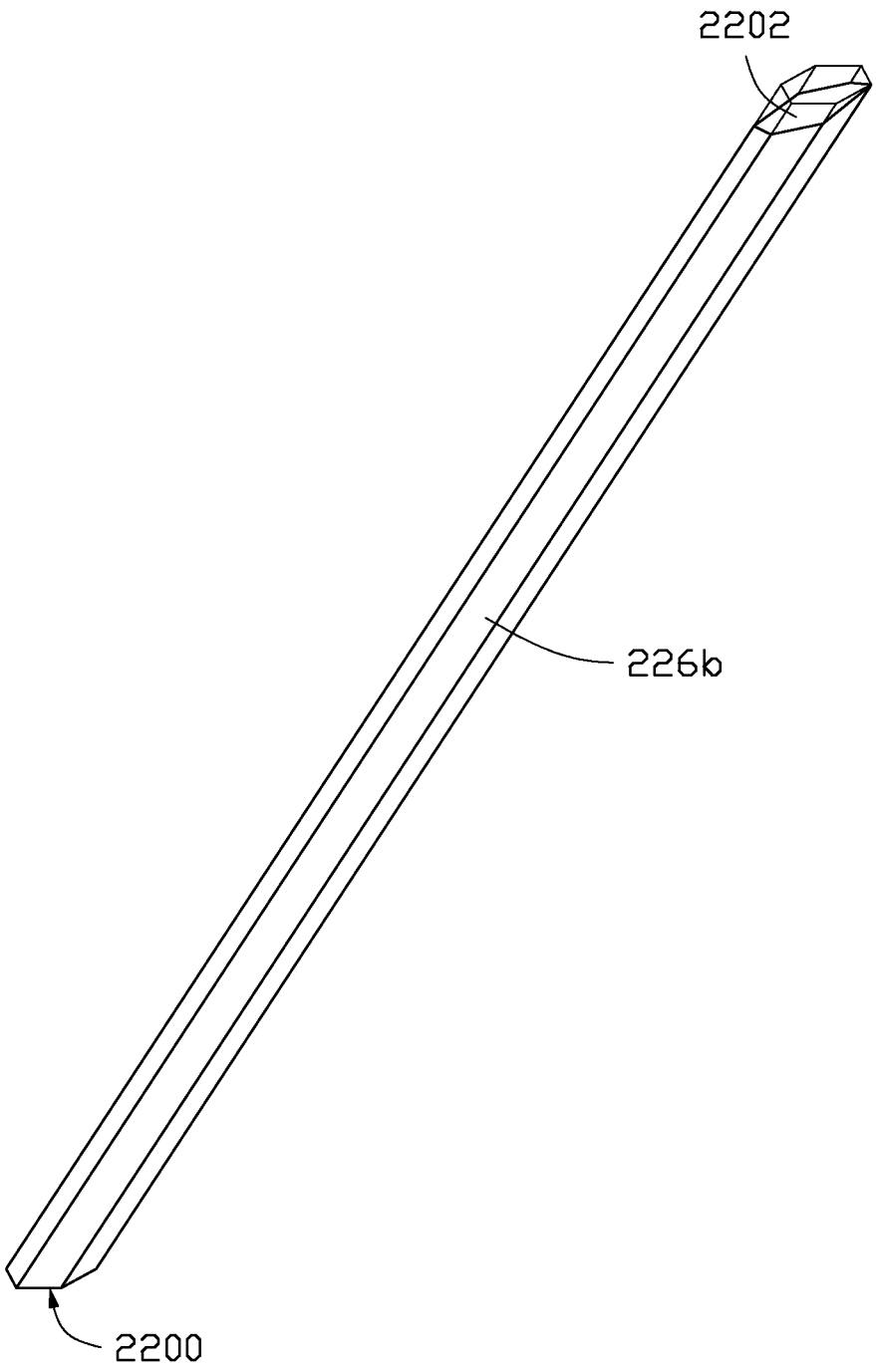
FIG. 13 is an isometric view of another embodiment of the light guiding channel.

FIG. 13 illustrates another embodiment of the light guiding fiber 226*b*. The light guiding fiber 226*b* is extended from the light incident surface 2200 towards to light emitting surface 2202. Cross sections of the light guiding fiber 226*b* are constant. An extending degree of the light guiding fiber 226*a* is related to inclined degree and diameter of the light guiding fiber 226*a*. In other embodiments, the light guiding channel 224 can be combined with a number of optical fibers, light guiding thin plates, silica fibers, glass fibers, or other light penetrating material.

Figure 14:
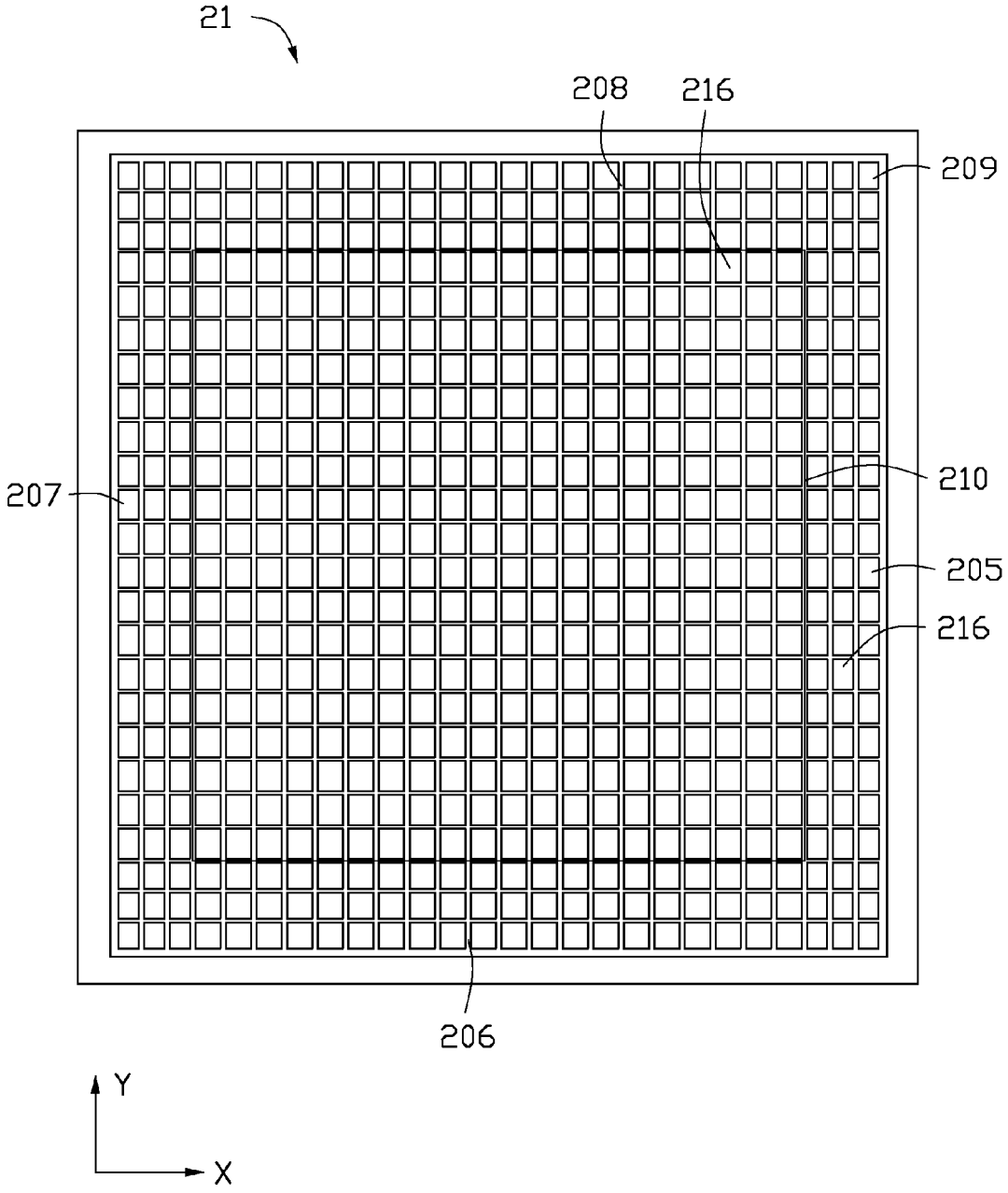
FIG. 14 is a diagrammatic view of an embodiment of the display of FIG. 10.

FIG. 14 illustrates a second embodiment of the display 20. A display panel 21 of the display 20 includes periphery display regions 205 and 207 located on right and left sides of the main display region 210. Widths of the periphery display region 205 and 207 are constant. Lengths of the periphery display regions 205 and 207 are equal to lengths of the main display region 210. A width of the pixel 216 in the periphery display region 205 and 207 is less than a width of the pixel 216 in the main display region 210. Lengths of the pixels 216 in the periphery display regions 206 and 208 located on an upper side and a lower side of the main display region 210 are constant. A width of the pixel 216 in the periphery display regions 206 and 208 is equal to a width of the pixel 216 in the main display region 210, and a length of the pixel 216 in the periphery display regions 206 and 208 is less than a length of the pixel 216 in the main display region 210. A length of the pixel 216 in the periphery display regions 209 located at corners is less than a length of the pixel 216 in the main display region 210, and a width of the pixels 216 in the periphery display regions 209 is less than a width of the pixel 216 in the main display region 210. A length of the pixel 216 in the periphery display regions 209 is equal to a length of the pixel 216 in the periphery regions 206 and 208, and a width of the pixel 216 in the periphery display regions 209 is equal to a width of the pixel 216 in the periphery regions 205, and 207. In other embodiments, the periphery display region 206 and 208 can be set on the image compensating apparatus 12.

An image covering region of the periphery display regions 205 to 209 is equal to an image covering region of the main display region 210. The pixels 216 in the periphery display regions 205 and 207 extend an image covering region in the width direction parallel with a direction X. The pixels 216 in the periphery display regions 206 and 208 extends an image covering region in the length direction parallel with a direction Y perpendicular to the direction X. The pixels 216 in the periphery display regions 209 extend an image covering region in the width direction and the length direction simultaneously.

When viewing the display 20, an image covering region of the periphery display region 212 is extended by the image compensating portion 220. A displaying region of the display 20 is being extended, and is greater than the size of the display 20. The display 20 has a zero border effect.

Figure 15:
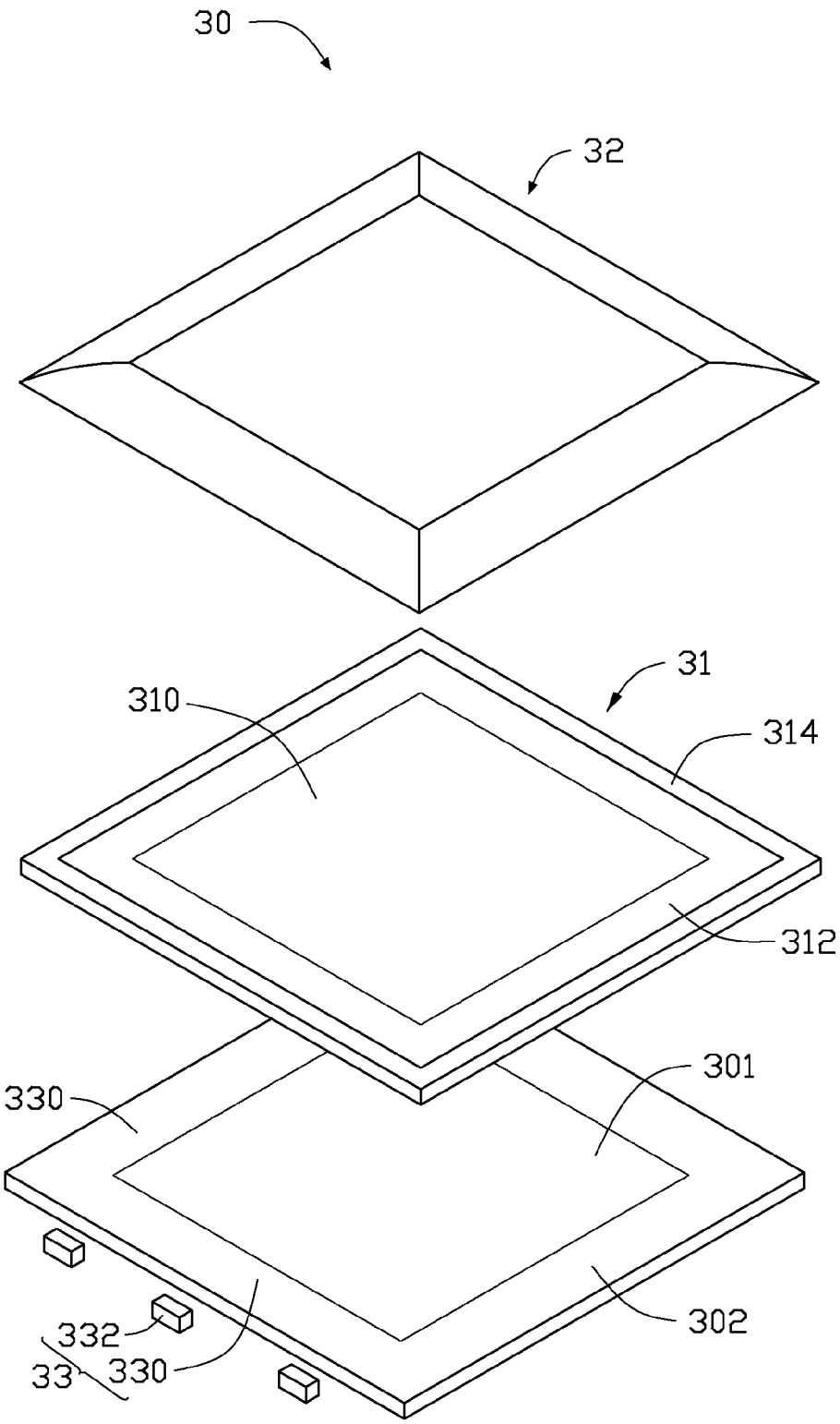
FIG. 15 is a partially exploded view of a third embodiment of the display.
Figure 16:
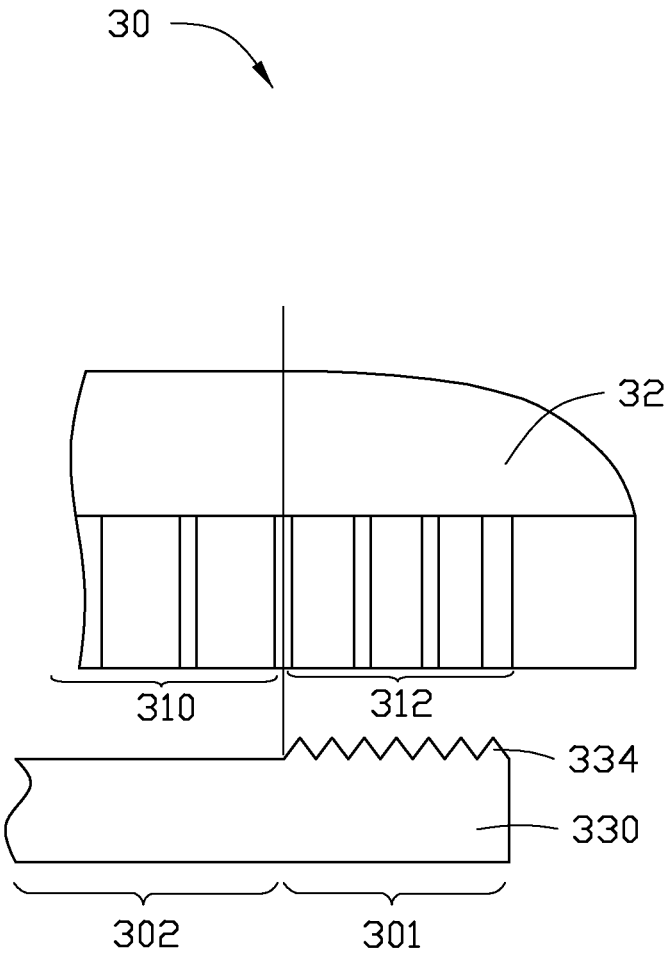
FIG. 16 is a cross-section view of a third embodiment of the display of FIG. 15.

FIGS. 15-16 illustrate a third embodiment of the display 30. The display 30 further includes a backlight module 33 located on a side of the image compensating portion 32. The backlight module 33 provides plane lights to the display panel 31. The backlight module 33 includes a main light emitting region 301 corresponding to the main display region 310, and a periphery light emitting region 302 corresponding to the periphery display region 312. An intensity of lights emitted by the main light emitting region 301 is greater than an intensity of lights emitted by the periphery light emitting region 302. The backlight module 33 further comprises a light source 332, a light guiding plate 330, and a brightness enhancement portion 334 corresponding to the periphery display region 312. The brightness enhancement portion 334 includes a plurality of V-shaped slots, prisms, or cylinder structures. Based on the light intensity difference in the main display region 312 and the periphery display region 310, sizes of the non-display region 314 is decreased in visual, and the original gray scale values in the periphery display region 312 are greater than the original gray scale value in the main display region 310 for directly converting the original gray scale into first driving signal. A display effect of the periphery display region 112 can be improved.

Figure 17:
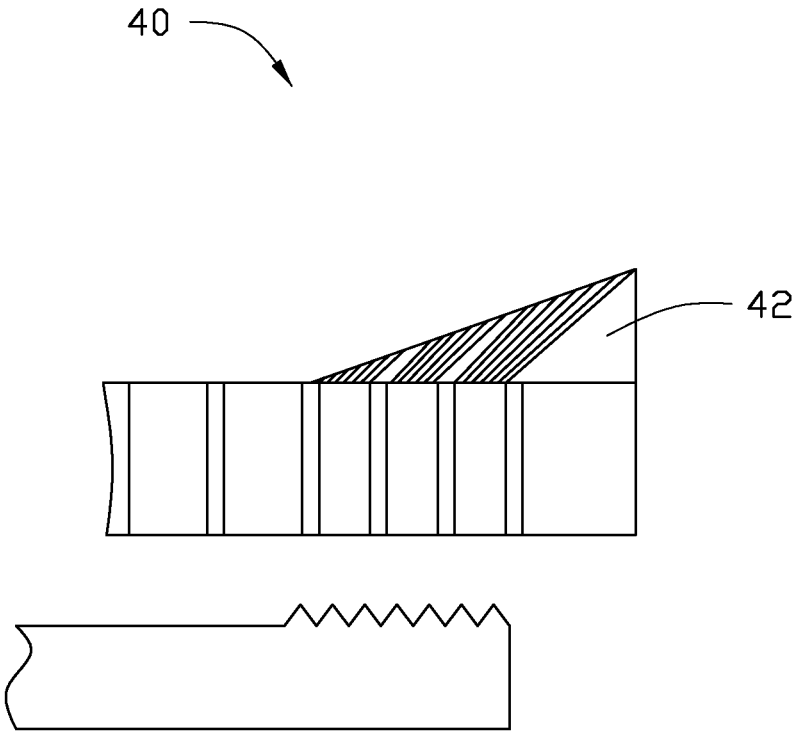
FIG. 17 is a cross-section view of a fourth embodiment of the display.

FIG. 17 illustrates a fourth embodiment of the display 40. The display 40 includes an image compensating portion 42. The structure of the image compensating portion 42 is equal to the image compensating portion 22.

Figure 18:
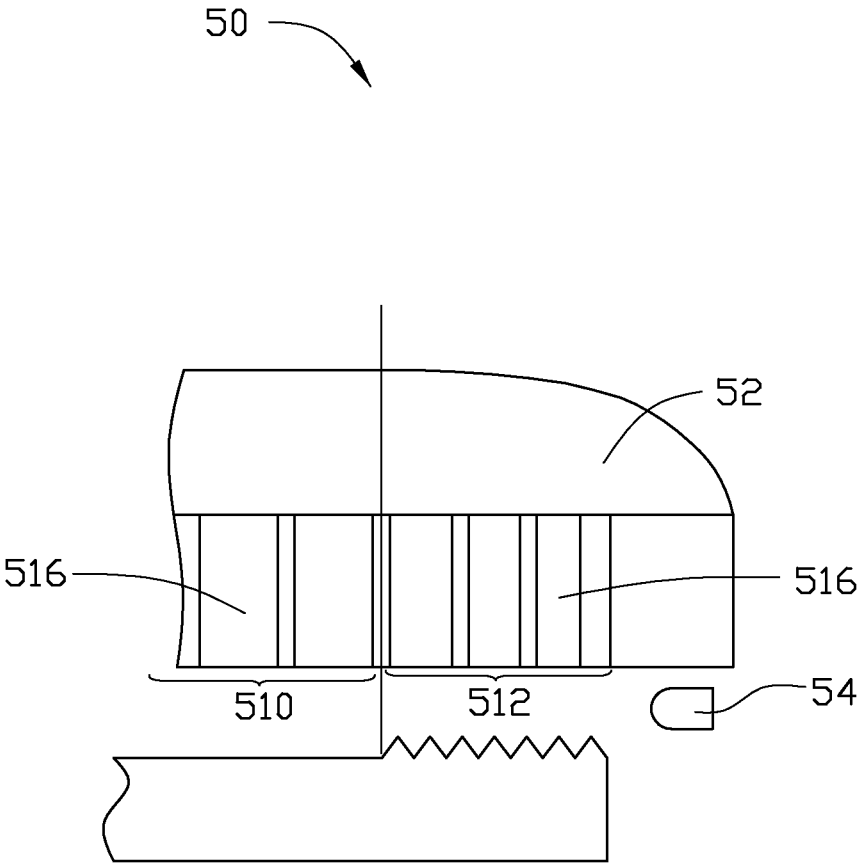
FIG. 18 is a cross-section view of a fifth embodiment of the display.

FIG. 18 illustrates a fifth embodiment of the display 50. The difference between the display 30 and the display 50 is an auxiliary light source 54 located adjacent to the periphery display region 512 for improving an intensity of lights emitted into the periphery display region 512. An intensity of lights emitted by the periphery display region 512 is greater than an intensity of lights emitted by the main display region 510. An intensity of lights passing through the image compensating apparatus 52 is reduced for being equal to the intensity of lights of the main display region 510.

Thus, an intensity of the display 50 is uniformity. In at least one embodiment, the auxiliary light source 54 is a light emitting diode.

Figure 19:
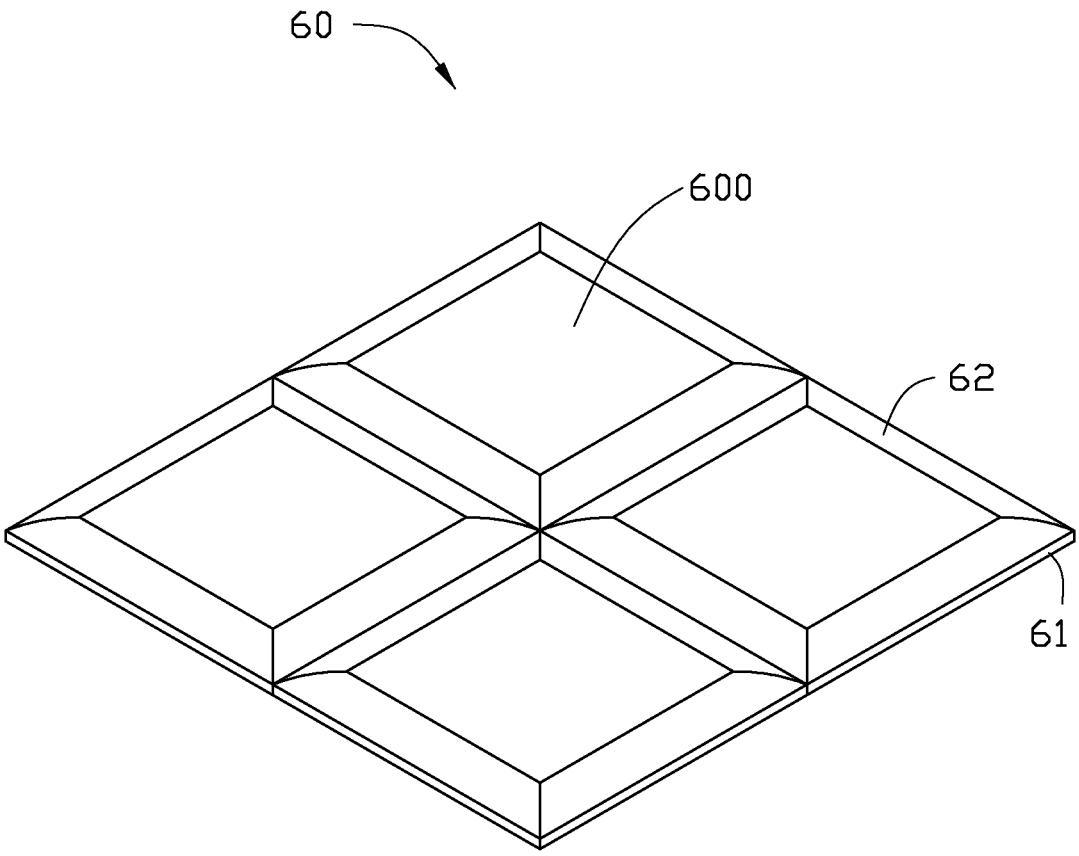
FIG. 19 is a diagrammatic view of an embodiment of the display assembly jointed by four displays.

FIG. 19 illustrates that the display assembly 60 includes a plurality of display 600 jointed together. The display 600 can be one of the display 10, 30, 50, or any suitable combination thereof. The display assembly 60 includes a display panel 61 and an image compensating apparatus 62.

Figure 20:
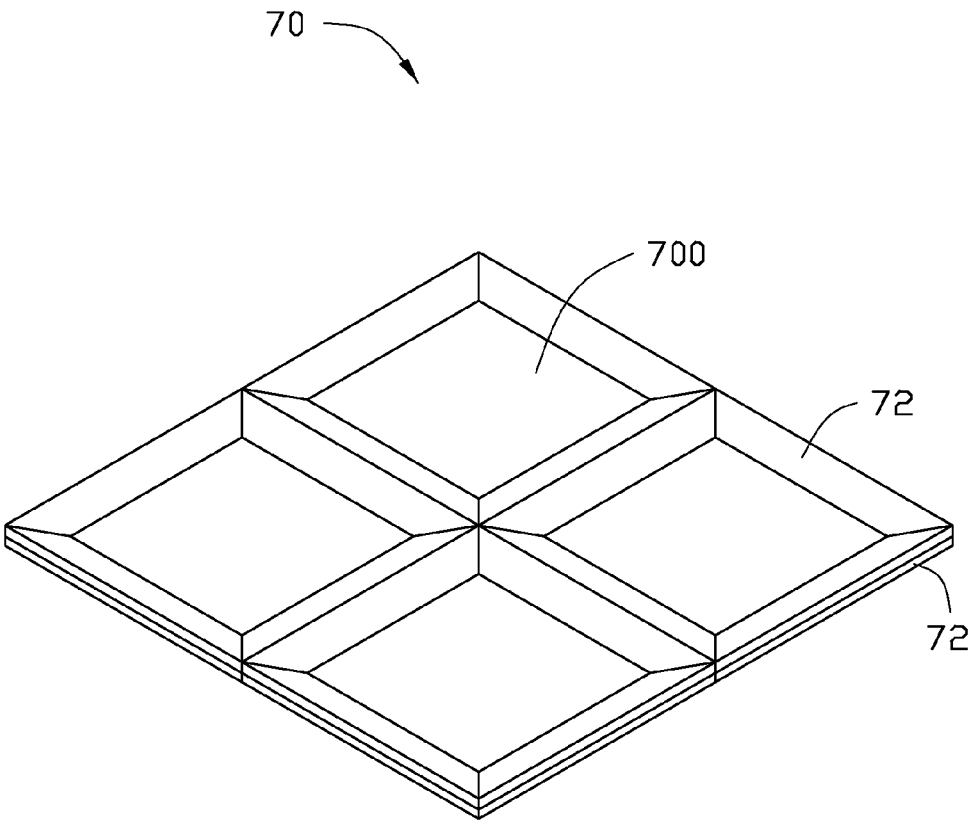
FIG. 20 is a diagrammatic view of another embodiment of the display assembly jointed by four displays

FIG. 20 illustrates the display assembly 70 includes a plurality of displays 700 jointed together. The display 700 of the display assembly 100 can be one of the displays 20, 40, or any suitable combination thereof. The display assembly 70 includes a display panel 71 and an image compensating apparatus 72.

In other embodiments, the display assemblies 60 and 70 can jointed together via jointing the display panel 61 and the display panel 71. The image compensating apparatus 62 and 72 are integrally formed.

In use, the image compensating apparatus 12 extends an image covering region of the display 10 for covering the non-display region 114, thus borders of the display 10 is invisible and the visual effect of the display 10 is improved The embodiments shown and described above are only examples. Even though numerous characteristics and advantages of the present technology have been set forth in the foregoing description, together with details of the structure and function of the present disclosure, the disclosure is illustrative only, and changes may be made in the detail, including matters of shape, size, and arrangement of the parts within the principles of the present disclosure, up to and including the full extent established by the broad general meaning of the terms used in the claims.

What is claimed is:

1. A display comprising: a display panel with a main display region and a periphery display region outside the main display region, the periphery display region including an image covering region; and an image compensating portion corresponding to the periphery display region, configured to extend the image covering region; wherein the main display region and the periphery display region respectively comprise a plurality of pixels; and a pixel density of the pixels in the periphery display region is greater than a pixel density of the pixels in the main display region; any two adjacent pixels in the main display region are spaced from each other in a first distance, any two adjacent pixels in the periphery display region are spaced from each other in a second distance; the first distance, is greater than the second distance; the image compensating portion is overlapped with the periphery display region in a direction perpendicular to the display panel, and extends an image displayed by the periphery display region to a non-display region outside the periphery display region; the display panel is configured such that when a pixel of the main display region and a pixel of the periphery display region have the same original gray scale, an intensity of light from the periphery display region is greater than an intensity of light from the main display region based on the pixel density difference between the periphery display region and the main display region.

2. The display of claim 1, further comprising a gray scale correction circuit and a driving circuit; wherein the gray scale correction circuit obtains a first correction gray scale value based on a first original gray scale value of the pixels in the periphery display region; the driving circuit converts the first correction gray scale value into a first driving signal, and the pixels in the periphery display region are driven by the first driving signal generated by the driving circuit.

3. The display of claim 2, wherein the gray scale correction circuit presets a first correction value; the gray scale correction circuit adds the first original gray scale value and the first correction value to obtain the first correction gray scale value.

4. The display of claim 2, wherein the gray scale correction circuit comprises a first look-up table; the first look-up table comprises a plurality of first original gray scale values and a plurality of first correction gray scale values corresponding to the first original gray scale values in a one-to-one relationship; the first correction gray scale value is obtained via searching the first original gray scale value in the first look-up table.

5. The display of claim 2, wherein the gray scale correction circuit comprises a first look-up table and a first adder; the first look-up table comprises a plurality of first original gray scale values and a plurality of first correction values corresponding to the first original gray scale values in a one-to-one relationship; the first correction value is obtained via searching the first original gray scale value in the first look-up table; the first adder adds the first original gray scale and the searched first correction value to obtain the first correction gray scale value.

6. The display of claim 2, wherein the driving circuit further converts a second original gray scale value of the main display region into a second driving signal; the pixels in the main display region are driven by the second driving signal converted by the driving circuit.

7. The display of claim 2, wherein the gray scale correction circuit obtains a second correction gray scale value based on a second original gray scale value of the pixels in the main display region.

8. The display of claim 7, wherein the gray scale correction circuit comprises a second look-up table; the second look-up table comprises a plurality of second original gray scale values and a plurality of second correction gray scale values corresponding to the second original gray scale values in a one-to-one relationship; the second correction gray scale value is obtained via searching the second original gray scale value in the second look-up table; the first correction gray scale value is greater than the second correction gray scale value.

9. The display of claim 7, wherein the gray scale correction circuit comprises a second look-up table and a second adder; the second look-up table comprises a plurality of second original gray scale values and a plurality of second correction values corresponding to the second original gray scale values in a one-to-one relationship; the second correction value is obtained via searching the second original gray scale value in the second look-up table; the second adder adds the second original gray scale and the searched second correction value to obtain the second correction gray scale value; the first correction gray scale value is greater than the second correction gray scale value.

10. The display of claim 1, wherein the periphery display region comprises a first region located at corners and a second region; based on an original gray scale value in the periphery display region, an intensity of light emitted by the pixels in the first region is greater than an intensity of light emitting by the pixels in the second region.

11. The display of claim 1, wherein areas of the pixels in the main display region are constant, and an area of each pixel in the periphery display region is less than the area of the pixel in the main display region.

12. The display of claim 11, wherein areas of the pixels in the periphery display region gradually decrease in a direction away from the main display region.

13. The display of claim 11, wherein areas of the pixels in the periphery display regions located in a width direction of the main display region are constant; areas of the pixels in the periphery display regions located in a length direction of the main display region are constant.

14. The display of claim 1, further comprising a backlight module; wherein the backlight module comprises a main light emitting region corresponding to the main display region and a periphery light emitting region corresponding to the periphery display region; an intensity of light emitted by the main light emitting region is greater than an intensity of light emitted by the periphery emitting region.

15. The display of claim 14, wherein the image compensating portion extends an image covering region of the periphery display region to cover an area combined by upper and outside regions of the periphery display region.

16. The display of claim 1, wherein the display further comprises an auxiliary light source located adjacent to the periphery display region; the auxiliary light source improves an intensity of light emitted by the periphery display region to be greater than an intensity of light emitted by the main display region.

17. A display assembly comprising:

at least two displays jointed together, each of the at least two displays comprising:

a display panel with a main display region and a periphery display region outside the main display region; and a gray scale correction circuit;

wherein each of the main display region and the periphery display region comprises a plurality of pixels with a first original gray scale value, the first original gray scale value corresponds to a standard intensity; the gray scale correction circuit corrects the first original gray scale value in the periphery display region; a pixel density of the pixels in the periphery display region is greater than a pixel density of the pixels in the main display region; any two adjacent pixels in the main display region are spaced from each other in a first distance, any two adjacent pixels in the periphery display region are spaced from each other in a second distance; the first distance is greater than the second distance; an intensity of light emitted from the periphery display region is greater than the standard intensity based on different pixel densities and the difference gray scales.

18. The display assembly of claim 17, further comprising a backlight module; wherein the display panel further comprises a main display region; the periphery display region surrounds the main display region; the backlight module comprises a main light emitting region corresponding to the main display region and a periphery light emitting region corresponding to the periphery display region; an intensity of light emitted by the main light emitting region is greater than an intensity of light emitted by the periphery emitting region; areas of the pixels in the main display region are constant, and an area of each pixel in the periphery display region is less than the area of the pixel in the main display region.

19. The display assembly of claim 18, wherein areas of the pixels in the periphery display region gradually decrease in a direction away from the main display region.

20. The display assembly of claim 18, wherein areas of the pixels in the periphery display regions located in a width direction of the main display region are constant; and areas of the pixels in the periphery display regions located in a length direction of the main display region are constant.

* * * * *